US006514929B1

(12) United States Patent
Kandasamy et al.

(10) Patent No.: US 6,514,929 B1
(45) Date of Patent: Feb. 4, 2003

(54) PROCESS FOR FORMING AN AGGLOMERATED PARTICLE

(75) Inventors: Manivannan Kandasamy, Higashinada-ku (JP); Tianli Wen, Chicago, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/856,588

(22) PCT Filed: Nov. 25, 1998

(86) PCT No.: PCT/US98/25229

§ 371 (c)(1), (2), (4) Date: Jun. 19, 2001

(87) PCT Pub. No.: WO00/31234

PCT Pub. Date: Jun. 2, 2000

(51) Int. Cl.[7] ..... C11D 17/06; C11D 3/37

(52) U.S. Cl. ..... 510/441; 510/351; 510/357; 510/426; 510/438; 510/444; 510/475

(58) Field of Search ..... 510/351, 357, 510/426, 438, 441, 444, 475

(56) References Cited

FOREIGN PATENT DOCUMENTS

| | | | | |
|---|---|---|---|---|
| EP | 0 206 513 A1 | | 12/1986 | |
| EP | WO 98/14550 | * | 4/1998 | ..... C11D/11/00 |
| EP | WO 00/31234 | * | 6/2000 | ..... C11D/17/06 |
| WO | WO 94/14939 | | 7/1994 | |
| WO | WO 98/14550 | | 4/1998 | |
| WO | WO 98/20098 | | 5/1998 | |

* cited by examiner

*Primary Examiner*—Mark Kopec
*Assistant Examiner*—Brian P. Mruk
(74) *Attorney, Agent, or Firm*—Brahm J. Corstanje; Kim William Zerby; Steven W. Miller

(57) ABSTRACT

The present invention relates to a process for forming an agglomerated particle containing the steps of providing at least one alkaline material, a core material, and at least one acid active. The alkaline material and the core material are added to a mixer and agglomerated therein, to form an agglomerated particle comprising an interior and an exterior. The acid active is then added to the mixer. The core material is concentrated into the interior of the agglomerated particle by adding substantially all of the core material to the alkaline material before more than about 50% of the acid active is added to the mixer.

10 Claims, No Drawings

PROCESS FOR FORMING AN AGGLOMERATED PARTICLE

FIELD

The present invention relates to a process for forming an agglomerated article. Specifically, the present invention relates to a process for forming an agglomerated particle containing a polymer.

BACKGROUND

An agglomerated particle in a cleaning composition, especially an agglomerated particle in a laundry composition, will typically contain an acidic species present during the production process. For example, the production process may utilize the acid active form of an anionic surfactant, which is neutralized during the production process. While certain anionic surfactants may be added as a pre-neutralized surfactant, in certain locales, such a pre-neutralized surfactant may be either unavailable, of unreliable quality, or excessively expensive. Accordingly, a typical production process adds an acid active, and neutralizes it therein.

Certain materials, such as polymers, are commonly added to an agglomerated particle to provide soil dispersion properties, anti-redeposition properties, fabric modification properties, etc. In addition, certain high-melting point liquids, including certain polymers, surfactant pastes, suds boosters, etc. may also be added to an agglomerated particle to provide additional desirable properties, such as cleaning properties, whitening properties, sudsing level adjustment, etc. While the class of polymers and high-melting point polymers overlaps, neither group is a complete subset of the other. Accordingly, either, or a combination thereof may be present in an agglomerated particle. One type of polymer which is especially useful in an agglomerated particle is a modified polyamine polymer. Such a modified polyamine polymer typically provides one or more of the desirable properties discussed above. Specifically, such a modified polyamine polymer may provide, for example, improved soil dispersion, anti-redeposition, and fabric modification properties. The modified polyamine polymer may contain, for example, additional charged or uncharged groups connected to a polymer backbone.

The agglomeration process produces an agglomerated particle which contains many concentric layers, which resemble an onion. Typically, polymers are introduced into the agglomeration process either along with the acid active, or with a liquid carrier at the end of the agglomeration process. These processes result in either an even distribution of the polymer throughout the various layers of the "onion," or a polymer concentrated on the exterior layers of the "onion," respectively.

The desirable properties of these polymers typically depend upon their molecular weight and the properties of any chemically modified groups attached thereto. The properties noted above are typically concentration-dependent; the greater the concentration of the polymer, the greater the effect. However, such polymers, and especially modified polyamine polymers, are typically expensive to produce. Therefore, they are typically used at relatively low concentrations. Thus, it is desirable to add an effective concentration of the polymer, and yet keep this concentration low enough so as not to excessively increase the formulation cost of the cleaning composition.

Granular cleaning compositions which contain high-melting point liquids are typically susceptible to caking and clumping during storage. Such caked granules are undesirable, both aesthetically and for performance reasons. For example, caked granules typically require a longer time to dissolve, as compared to free-flowing granules. Undissolved or incompletely dissolved granules may also leave an undesirable film or residue on the substrate.

Accordingly, the need remains for a process which incorporates a polymer into an agglomerated particle at a concentration which maintains polymer properties, free-flow properties, and performance profiles without increasing formulation costs. The need also remains for a process which incorporates a high-melting point liquid into an agglomerated particle, while maintaining acceptable free-flow properties.

SUMMARY

It has now been found that an acid active present in an agglomeration process may degrade certain polymers, causing them to disintegrate into lower molecular weight fragments which are significantly less effective in providing the desired polymer properties. Such a polymer is therefore described herein as an "acid-sensitive polymer." In addition, it has now been found that a high-melting point liquid may be incorporated into an agglomerated particle while maintaining acceptable free-flow properties. Thus, the present invention relates to an improved process for forming an agglomerated particle containing an acid active and a core material selected from the group consisting of an acid-sensitive polymer, a high-melting point liquid, and mixtures thereof. When an acid-sensitive polymer is present, this improved process reduces acid-sensitive polymer degradation by concentrating it into the alkaline interior of the agglomerated particle, and results in maintained polymer properties, free-flow properties, and performance profiles without increasing formulation costs. When a high-melting point liquid is employed herein, the improved process maintains free-flow properties in an agglomerated particle by concentrating it into the interior of the particle.

The present invention relates to a process for forming an agglomerated particle containing the steps of providing at least one alkaline material, a core material selected from the group consisting of an acid-sensitive polymer, a high-melting point liquid, and mixtures thereof, and at least one acid active. The alkaline material and the core material are added to a mixer and agglomerated therein, to form an agglomerated particle comprising an interior and an exterior. The acid active is then added to the mixer. The core material is concentrated into the interior of the agglomerated particle by adding substantially all of the core material to the alkaline material before more than about 50% of the acid active is added to the mixer.

These and other features, aspects, and advantages of the present invention will become evident to those skilled in the art from a reading of the present disclosure with the appended claims.

DETAILED DESCRIPTION

In accordance with the present invention it has been found that an agglomerated particle may utilize both an acid active and an acid-sensitive polymer and yet avoid acid-induced degradation of the acid-sensitive polymer over time. This improved process reduces degradation, and therefore improves the effectiveness of a given amount of acid-sensitive polymer in a cleaning composition. As there is no need to add extra acid-sensitive polymer in order to compensate for expected degradation, this improved process may also maintain the performance profile and benefits of the polymer while reducing formulation costs. When a high-melting point liquid is employed herein, the present process also results in an agglomerated particle which possesses acceptable free-flow properties, such as reduced caking.

All percentages, ratios and proportions herein are by weight of the agglomerated particle, unless otherwise specified. All temperatures are in degrees Celsius (°C.), unless otherwise specified. All documents cited are incorporated herein by reference.

As used herein, the term "alkyl" means a hydrocarbyl moiety which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, the term "RPM" indicates revolutions per minute.

In accordance with the present invention, it has been recognized that specific problems associated with certain materials, such as a high-melting point liquid, an acid-sensitive polymer, and mixtures thereof may be avoided by incorporating them into the core of an agglomerated particle. Such materials are hereinafter referred to as "core materials." In accordance with the present invention, it has been recognized that an acid, and especially an acid active present in a typical agglomeration process may degrade certain polymers, so as to decrease their effectiveness in a cleaning composition. Such a polymer is therefore described herein as an "acid-sensitive polymer." Without intending to be limited by theory, it is believed that an acid active may react with the acid-sensitive polymer to cause it to degrade, for example, by reacting with an active group to reduce the acid-sensitive polymer's properties, e.g., soil dispersion properties, in the cleaning composition. Alternatively, an acid active may react with the acid-sensitive polymer's backbone to hydrolyze and disintegrate it into smaller fragments which are significantly less effective in a cleaning composition.

The present process also reduces undesirable polymerization of the acid-sensitive polymer. Without intending to be limited by theory, it is believed that certain acid-sensitive polymers may undesirably form homopolymers or copolymers when exposed to acid. Such undesirable polymerization may destroy or reduce the polymer's effectiveness and performance profile in the final composition.

Although the alkaline material is at excess in the typical detergent composition, it has surprisingly been found that a significant portion of the acid active (e.g., from about 20–50%) may not be fully neutralized until hours after the agglomeration process is completed. Thus, it has been found that acid active present on the outside of the agglomerated particle may take days to be come fully neutralized, or in some cases, may never become fully neutralized. It has therefore been recognized that while acid active present in the interior of the agglomerated particle is neutralized immediately, the acid active present on the exterior of the particle may remain acidic long after the agglomeration process is completed. During this time, the acid active present on the exterior of the agglomerated particle may degrade the acid-sensitive polymers, if these acid-sensitive polymers are uniformly dispersed throughout the particle.

In an agglomeration process, the first ingredients added are typically concentrated into the interior of the particle, with subsequently-added ingredients appearing on concentric, successive outer layers of the particle. The present process adds substantially all of the core material to the alkaline material before more than 50% of the acid active is added to the mixer. After the core material is added to the mixer, the remaining acid active is added. Agglomeration proceeds until after all of the ingredients are added.

When the core material contains an acid-sensitive polymer, this improved process reduces degradation by concentrating the acid-sensitive polymer into the highly alkaline interior of the agglomerated particle, i.e., the interior of the "onion." Without intending to be limited by theory, it is believed that the interior of the agglomerated particle provides an alkaline environment which protects the acid-sensitive polymer from degradation caused by acid. It is further believed that degradation reactions are minimized because the acid-sensitive polymer is surrounded on all sides by excess alkaline material; any acid active present with the acid-sensitive polymer will thus react immediately with the excess alkaline material to become substantially neutralized, before it has a chance to react with the acid-sensitive polymer.

Furthermore, the present process protects the acid-sensitive polymer from acid active remaining on the exterior of the agglomerated particle. In the agglomerated particles made by this process, the acid-sensitive polymer-containing-interior is surrounded by many layers of alkaline material. These surrounding layers also protect the acid-sensitive polymer from degradation from the acid active. Thus, because the acid-sensitive polymer is concentrated in the interior of the particle, any acid active remaining on the exterior of the particle must travel through many intervening layers of alkaline material in order to reach, and then degrade the acid-sensitive polymer. As the acid active from the exterior is likely to be neutralized before it reaches the acid-sensitive polymer, the surrounding layers of alkaline material provide an additional level of protection.

This improved process also provides additional benefits. For example, as the acid-sensitive polymers are typically expensive, the present invention reduces formulation costs by requiring the addition of less acid-sensitive polymer to provide the same beneficial effects. Conversely, as the beneficial effects of such acid-sensitive polymers are typically dependent upon their concentration in the cleaning composition, the present process improves the overall effectiveness of a given concentration of acid-sensitive polymer.

When the core material contains a high-melting point liquid, the present process also provides the surprising advantage of producing free-flowing granules with reduced susceptibility to caking. This feature is highly desirable in a granular cleaning composition, as it improves the composition's aesthetics and dissolution profile. Without intending to be limited by theory, it is believed that when a high-melting point liquid is added to the typical agglomeration process, it is distributed throughout the entire particle. However, in such a particle, the high-melting point liquid may diffuse to the surface of the particle over time, for example, during storage. When this occurs, the particle itself becomes sticky, and tends to clump together with other particles. This further results in caking, and reduced free-flow properties of the composition, which in turn leads to reduced performance and solubility. However, it has now surprisingly been found that when such a high-melting point liquid is concentrated in the interior of an agglomerated particle, as by the present invention, acceptable free-flow properties are maintained. Without intending to be limited by theory, it is believed that when it is concentrated in the interior of the agglomerated particle, rather than scattered throughout the entire particle, the high-melting point liquid is less likely to diffuse to the surface. This results in particles which possess acceptable free-flow properties, are less sticky, and are less prone to caking and clumping. Furthermore, when the high-melting point liquid is also an acid-sensitive polymer, this process reduces acid-induced degradation by reducing diffusion of the acid-sensitive polymer to the exterior of the agglomerated particle. The agglomerated particle made by the present process may be used by itself as a cleaning composition, or may be mixed with another composition to form a cleaning composition.

In the process of the present invention, at least one alkaline material is provided with which to neutralize the acid active. The alkaline material may be any of those useful in a cleaning composition, and especially a laundry composition. The alkaline material is typically selected from alkali metal and alkali earth metal carbonate, phosphate, silicate, layered silicate, hydroxide, and mixtures thereof.

Preferred examples of the carbonate useful herein include the bicarbonates and sesquicarbonates, more preferably, sodium carbonate (i.e., soda ash), potassium carbonate, and mixtures thereof.

Where permitted, alkali and alkali earth metal phosphates are especially useful herein as they may serve as both an alkaline material, as well as a builder. If present, the builder may assist in controlling mineral hardness and in the removal of particulate soils. Preferred phosphates useful herein include, but are not limited to, the alkali metal, ammonium and alkanolammonium salts of polyphosphates (exemplified by the tripolyphosphates, pyrophosphates, and glassy polymeric meta-phosphates), phosphonates, and mixtures thereof.

The alkali metal and alkali earth metal silicate and layered silicate are also useful herein. Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to Rieck. NaSKS-6 is the trademark for a crystalline layered silicate marketed by Hoechst (commonly abbreviated herein as "SKS-6"). NaSKS-6 has the delta-$Na_2SiO_5$ morphology form of layered silicate. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

The hydroxide useful herein is preferably sodium hydroxide, such as is used in a caustic neutralization process. Typically, an aqueous solution of caustic sodium hydroxide is added to the mixer, in order to neutralize the acid active.

The alkaline material useful herein is typically provided in the cleaning composition in at least a stoichiometric molar ratio sufficient to completely neutralize the acid active. Typically, the alkaline material is in stoichiometric excess. The stoichiometric molar ratio of alkaline material to acid active is at least 1:1, preferably at least about 4:1, and more preferably at least about 7:1.

A core material is provided herein is selected from the group consisting of an acid-sensitive polymer, a high-melting point liquid, and mixtures thereof. While certain acid-sensitive polymers are also high-melting point liquids, these classifications also include many non-overlapping compounds. Accordingly, both of these are discussed in more detail, below.

The acid-sensitive polymer provided herein, undesirably degrades when exposed to an acid active. As noted above, this degradation may result, for example, from chemical reactions with the acid-sensitive polymer's active groups, from actual fragmentation of the acid-sensitive polymer's backbone, or from undesirable polymerization. Preferred acid-sensitive polymers useful herein include soil dispersion polymers, anti-redeposition polymers, fabric conditioning polymers, and mixtures thereof. More preferred classes of polymers useful herein include modified polyamine polymers, polyacrylate polymers, co-polymers of acrylic and maleic acids, and mixtures thereof.

Modified polyamine polymers are especially preferred herein as an acid-sensitive polymer. These polymers have shown a high susceptibility to acid-induced degradation when added with an acid active in the normal agglomeration processes. The modified polyamine polymers useful herein are even more preferably modified polyethyleneimine polymers which comprise either linear or cyclic backbones. The polyamine backbones can also comprise polyamine branching chains to a greater or lesser degree. In general, the polyamine backbones described herein are modified in such a manner that each nitrogen of the polyamine chain is thereafter described in terms of a unit that is substituted, quaternized, oxidized, or combinations thereof.

For the purposes of the present invention the term "modification" is defined as replacing a backbone —NH hydrogen atom by an E unit (substitution), quaternizing a backbone nitrogen (quaternized) or oxidizing a backbone nitrogen to the N-oxide (oxidized). The terms "modification" and "substitution" are used interchangeably when referring to the process of replacing a hydrogen atom attached to a backbone nitrogen with an E unit. Quaternization or oxidation may take place in some circumstances without substitution, but substitution is preferably accompanied by oxidation or quaternization of at least one backbone nitrogen.

The linear or non-cyclic polyamine backbones that comprise the modified polyethyleneimine polymers of the present invention have the general formula:

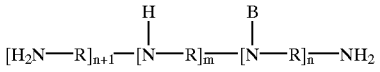

said backbones prior to subsequent modification, comprise primary, secondary and tertiary amine nitrogens connected by R "linking" units. The cyclic polyamine backbones comprising the modified polyethyleneimine polymers of the present invention have the general formula:

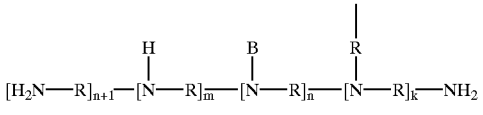

said backbones prior to subsequent modification, comprise primary, secondary and tertiary amine nitrogens connected by R "linking" units For the purpose of the present invention, primary amine nitrogens comprising the backbone or branching chain once modified are defined as V or Z "terminal" units. For example, when a primary amine moiety, located at the end of the main polyamine backbone or branching chain having the structure:

$$H_2N—R]—$$

is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure:

$$—NH_2$$

is modified according to the present invention, it is thereafter defined as a Z "terminal" unit, or simply a Z unit. This unit can remain unmodified subject to the restrictions further described herein below.

In a similar manner, secondary amine nitrogens comprising the backbone or branching chain once modified are defined as W "backbone" units. For example, when a secondary amine moiety, the major constituent of the backbones and branching chains of the present invention, having the structure:

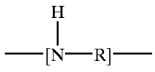

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, wherein B represents a continuation of the chain structure by branching, having the structure:

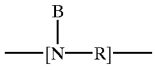

is modified according to the present invention, it is thereafter defined as a Y "branching" unit, or simply a Y unit. However, for the purposes of the present invention, some or all or the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described herein below.

The final modified structure of the modified polyethyleneimine polymers of the present invention can be therefore represented by the general formula:

$$V_{(n+1)}W_mY_nZ$$

for linear modified polyethyleneimine polymers and by the general formula:

$$V_{(n-k+1)}W_mY_nY'_kZ$$

for cyclic modified polyethyleneimine polymers. For the case of modified polyethyleneimine polymers comprising rings, a Y' unit of the formula:

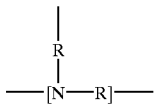

serves as a branch point for a backbone or branch ring. For every Y' unit there is a Y unit having the formula:

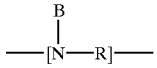

that will form the connection point of the ring to the main polymer chain or branch. In the unique case where the backbone is a complete ring, the polyamine backbone has the formula:

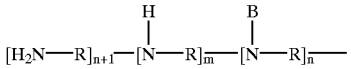

therefore comprising no Z terminal unit and having the formula:

$$V_{n-k}W_mY_nY'_k$$

wherein k is the number of ring forming branching units. Preferably the polyamine backbones of the present invention comprise no rings.

In the case of non-cyclic modified polyethyleneimine polymers, the ratio of the index n to the index m relates to the relative degree of branching. A fully non-branched linear modified polyethyleneimine polymer according to the present invention has the formula:

$$VW_mZ$$

that is, n is equal to 0. The greater the value of n (the lower the ratio of m to n), the greater the degree of branching in the molecule. Typically the value for m ranges from a minimum value of 4 to about 400, however larger values of m, especially when the value of the index n is very low or nearly 0, are also preferred.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, or Z units depending on whether they are primary, secondary or tertiary nitrogens. That is unmodified primary amine nitrogens are V or Z units, unmodified secondary amine nitrogens are W units and unmodified tertiary amine nitrogens are Y units for the purposes of the present invention.

Modified primary amine moieties are defined as V "terminal" units having one of three forms:

a) simple substituted units having the structure:

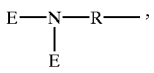

b) quaternized units having the structure:

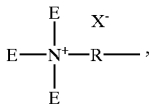

wherein X is a suitable counter ion providing charge balance; and c) oxidized units having the structure:

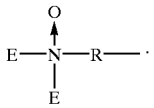

Modified secondary amine moieties are defined as W "backbone" units having one of three forms:

a) simple substituted units having the structure:

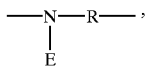

b) quaternized units having the structure:

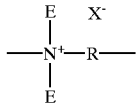

wherein X is a suitable counter ion providing charge balance; and c) oxidized units having the structure:

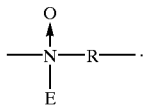

Modified tertiary amine moieties are defined as Y "branching" units having one of three forms:

a) unmodified units having the structure:

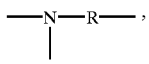

b) quaternized units having the structure:

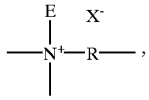

wherein X is a suitable counter ion providing charge balance; and c) oxidized units having the structure:

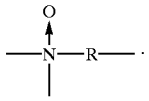

Certain modified primary amine moieties are defined as Z "terminal" units having one of three forms:

a) simple substituted units having the structure:

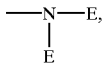

b) quaternized units having the structure:

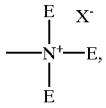

wherein X is a suitable counter ion providing charge balance; and c) oxidized units having the structure:

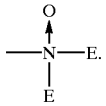

When any position on a nitrogen is unsubstituted of unmodified, it is understood that hydrogen will substitute for E. For example, a primary amine unit comprising one E unit in the form of a hydroxyethyl moiety is a V terminal unit having the formula:

$(HOCH_2CH_2)HN—$.

For the purposes of the present invention there are two types of chain terminating units, the V and Z units. The Z "terminal" unit derives from a terminal primary amino moiety of the structure $—NH_2$. Non-cyclic polyamine backbones according to the present invention comprise only one Z unit whereas cyclic polyamines can comprise no Z units. The Z "terminal" unit can be substituted with any of the E units described further herein below, except when the Z unit is modified to form an N-oxide. In the case where the Z unit nitrogen is oxidized to an N-oxide, the nitrogen must be modified and therefore E cannot be a hydrogen.

The modified polyethyleneimine polymers of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety may take any position on the R unit chain except the carbon atoms directly connected to the polyamine backbone nitrogens; $C_4$–$C_{12}$ dihydroxyalkylene wherein the hydroxyl moieties may occupy any two of the carbon atoms of the R unit chain except those carbon atoms directly connected to the polyamine backbone nitrogens; $C_8$–$C_{12}$ dialkylarylene which for the purpose of the present invention are arylene moieties having two alkyl substituent groups as part of the linking chain. For example, a dialkylarylene unit has the formula:

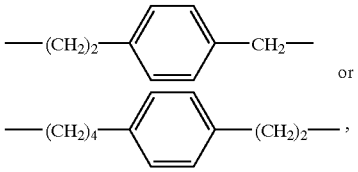

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise—$(R^1O)_xR^5(OR^1)_x$—, —$CH_2CH(OR^2)CH_2O)_z(R^1O)_yR^1(OCH_2CH(OR^2)CH_2)_w$—, —$CH_2CH(OR^2)CH_2$—, —$(R^1O)_xR^1$—, and mixtures thereof. Preferred R units are $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, —$(R^1O)_xR^1$—, —$CH_2CH(OR^2)CH_2$—, —$(CH_2CH(OH)CH_2O)_z(R^1O)_yR^1(OCH_2CH$—$(OH)CH_2)_w$—, —$(R^1O)_xR^5(OR^1)_x$—, more preferred R units are $C_2$–$C_{12}$ alkylene, $C_3$–$C_{12}$ hydroxy-alkylene, $C_4$–$C_{12}$ dihydroxyalkylene, —$(R^1O)_xR^1$—, —$(R^1O)_xR^5(OR^1)_x$—, —$(CH_2CH(OH)CH_2O)_z(R^1O)_yR^1(OCH_2CH$—$(OH)CH_2)_w$—, and mixtures thereof, even more preferred R units are $C_2$–$C_{12}$ alkylene, $C_3$ hydroxyalkylene, and mixtures thereof, most preferred are $C_2$–$C_6$ alkylene. The most preferred backbones of the present invention comprise at least 50% R units that are ethylene.

$R^1$ units are $C_2$–$C_6$ alkylene, and mixtures thereof, preferably ethylene. $R^2$ is hydrogen, and —$(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof , preferably $C_1$–$C_{12}$ alkyl, $C_7$–$C_{12}$ arylalkylene, more preferably $C_1$–$C_{12}$ alkyl, most preferably methyl. $R^3$ units serve as part of E units described herein below.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{10}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —$C(O)NHR^6NHC(O)$—, —$C(O)(R^4)_rC(O)$—, —$R^1(OR^1)$—, —$CH_2CH(OH)CH_2O(R^1O)_yR^1OCH_2CH(OH)CH_2$—, —$C(O)(R^4)_rC(O)$—, —$CH_2CH(OH)CH_2$—, $R^5$ is preferably ethylene, —C(O)—, —$C(O)NHR^6NHC(O)$—, —$R^1(OR^1)$—, —$CH_2CH(OH)CH_2$—, —$CH_2CH(OH)CH_2O(R^1O)_yR^1OCH_2CH$—$(OH)CH_2$—, more preferably —$CH_2CH(OH)CH_2$—.

$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred modified polyethyleneimine polymers of the present invention comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into —$(CH_2CH_2O)_xR^5(OCH_2CH_2)_x$— yields —$(CH_2CH_2O)_xCH_2CHOHCH_2(OCH_2CH_2)_x$—.

ii) Substituting preferred $R^1$ and $R^2$ into —$(CH_2CH(OR^2)CH_2O)_z$—$(R^1O)_yR^1O(CH_2CH(OR^2)CH_2)_w$— yields —$(CH_2CH(OH)CH_2O)_z$—$(CH_2CH_2O)_yCH_2CH_2O(CH_2CH(OH)CH_2)_w$—.

iii) Substituting preferred $R^2$ into —$CH_2CH(OR^2)CH_2$— yields —$CH_2CH(OH)CH_2$—.

E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_mB$, —$C(O)R^3$, preferably hydrogen, $C_2$–$C_{22}$ hydroxyalkylene, benzyl, $C_1$–$C_{22}$ alkylene, —$(R^1O)_mB$, —$C(O)R^3$, —$(CH_2)_pCO_2M$, —$(CH_2)_qSO_3M$, —$CH(CH_2CO_2M)CO_2M$, more preferably $C_1$–$C_{22}$ alkylene, —$(R^1O)_xB$, —$C(O)R^3$, —$(CH_2)_pCO_2M$, —$(CH_2)_qSO_3M$, —$CH(CH_2CO_2M)CO_2M$, most preferably $C_1$–$C_{22}$ alkylene, —$(R^1))_xB$, and —$C(O)R^3$. When no modification or substitution is made on a nitrogen then hydrogen atom will remain as the moiety representing E.

E units do not comprise hydrogen atom when the V, W or Z units are oxidized, that is the nitrogens are N-oxides. For example, the backbone chain or branching chains do not comprise units of the following structure:

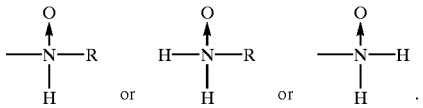

Additionally, E units do not comprise carbonyl moieties directly bonded to a nitrogen atom when the V, W or Z units are oxidized, that is, the nitrogens are N-oxides. According to the present invention, the E unit —$C(O)R^3$ moiety is not bonded to an N-oxide modified nitrogen, that is, there are no N-oxide amides having the structure:

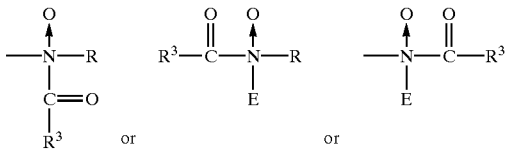

or combinations thereof.

B is hydrogen, $C_1$–$C_6$ alkyl, —$(CH_2)_qSO_3M$, —$(CH_2)_pCO_2M$, —$(CH_2)_q$—$(CHSO_3M)CH_2SO_3M$, —$(CH_2)_q(CHSO_2M)CH_2SO_3M$, —$(CH_2)_pPO_3M$, —$PO_3M$, preferably hydrogen, —$(CH_2)_qSO_3M$, —$(CH_2)_q(CHSO_3M)CH_2SO_3M$, —$(CH_2)_q$—$(CHSO_2M)CH_2SO_3M$, more preferably hydrogen or —$(CH_2)_qSO_3M$.

M is hydrogen or a water soluble cation in sufficient amount to satisfy charge balance. For example, a sodium cation equally satisfies —$(CH_2)_pCO_2M$, and —$(CH_2)_qSO_3M$, thereby resulting in —$(CH_2)_pCO_2Na$, and —$(CH_2)_qSO_3Na$ moieties. More than one monovalent cation, (sodium, potassium, etc.) can be combined to satisfy the required chemical charge balance. However, more than one anionic group may be charge balanced by a divalent cation, or more than one monovalent cation may be necessary to satisfy the charge requirements of a poly-anionic radical. For example, a —$(CH_2)_pPO_3M$ moiety substituted with sodium atoms has the formula —$(CH_2)_pPO_3Na_3$. Divalent cations such as calcium ($Ca^{2+}$) or magnesium ($Mg^{2+}$) may be substituted for or combined with other suitable monovalent water soluble cations. Preferred cations are sodium and potassium, more preferred is sodium.

X is a water soluble anion such as chlorine ($Cl^-$), bromine ($Br^-$) and iodine ($I^-$) or X can be any negatively charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; m has the value from 4 to about 400, n has the value from 0 to about 200; m+n has the value of at least 5.

The preferred modified polyethyleneimine polymers of the present invention comprise polyamine backbones wherein less than about 50% of the R groups comprise "oxy" R units, preferably less than about 20%, more preferably less than 5%, most preferably the R units comprise no "oxy" R units.

The most preferred modified polyethyleneimine polymers which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The modified polyethyleneimine polymers of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone. The proper manipulation of these "R unit chain lengths" provides the formulator with the ability to modify the solubility and fabric substantivity of the modified polyethyleneimine polymers of the present invention.

Preferred modified polyethyleneimine polymers of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneamines (PAA's), polyalkyleneimines (PAI's), preferably polyethyleneamine (PEA's), polyethyleneimines (PEI's), or PEA's or PEI's connected by moieties having longer R units than the parent PAA's, PAI's, PEA's or PEI's. A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Preferred amine polymer backbones comprise R units that are $C_2$ alkylene (ethylene) units, also known as polyethyleneimines (PEI's). Preferred PEI's have at least moderate branching, that is the ratio of m to n is less than 4:1, however PEI's having a ratio of m to n of about 2:1 are most preferred. Preferred backbones, prior to modification have the general formula:

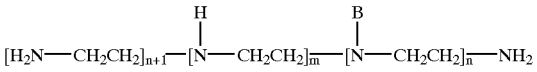

wherein m and n are the same as defined herein above. Preferred PEI's, prior to modification, will have a molecular weight greater than about 200 Daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These modified polyethyleneimine polymers can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of modified polyethyleneimine polymers of the present invention comprising PEI's, are illustrated in Formulas I–IV:

Formula I depicts a modified polyethyleneimine polymer comprising a PEI backbone wherein all substitutable nitrogens are modified by replacement of hydrogen with a polyoxyalkyleneoxy unit, $—(CH_2CH_2O)_7H$, having the formula:

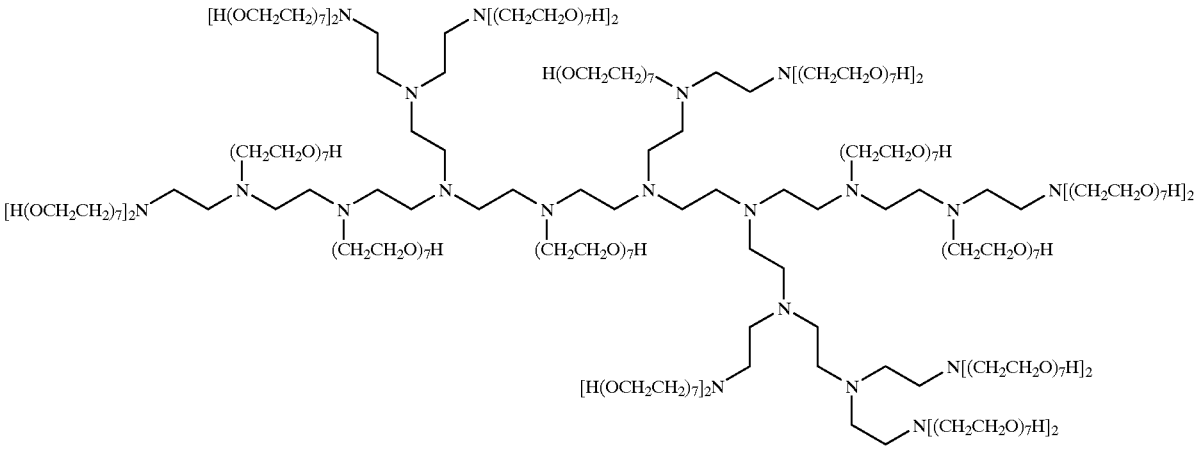

This is an example of a modified polyethyleneimine polymer that is fully modified by one type of moiety.

Formula II depicts a modified polyethyleneimine polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides, said modified polyethyleneimine polymer having the formula:

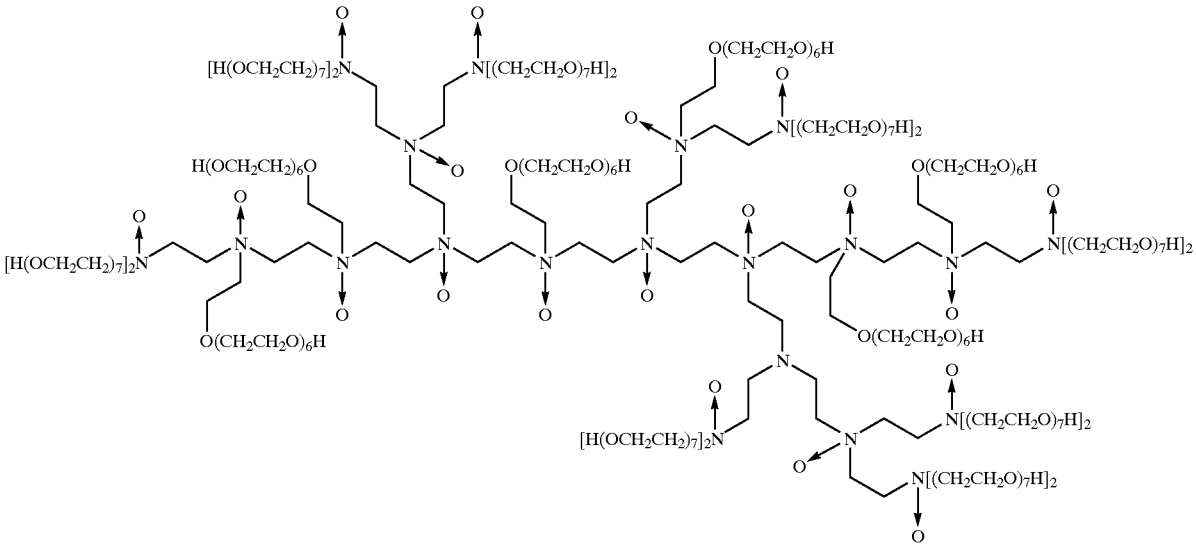

Formula III depicts a modified polyethyleneimine polymer comprising a PEI backbone wherein all backbone hydrogen atoms are substituted and some backbone amine units are quaternized. The substituents are polyoxyalkyleneoxy units, —$(CH_2CH_2O)_7H$, or methyl groups. The modified PEI soil release polymer has the formula:

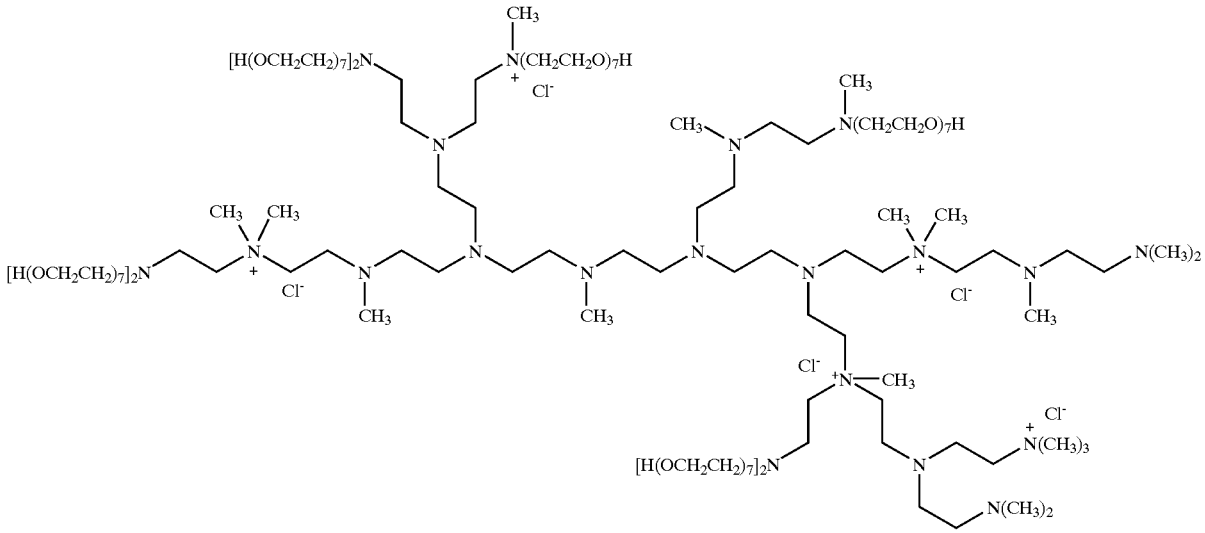

Formula IV depicts a modified polyethyleneimine polymer comprising a PEI backbone wherein the backbone nitrogens are modified by substitution (i.e. by —$(CH_2CH_2O)_7H$ or methyl), quaternized, oxidized to N-oxides or combinations thereof. The resulting modified polyethyleneimine polymer has the formula:

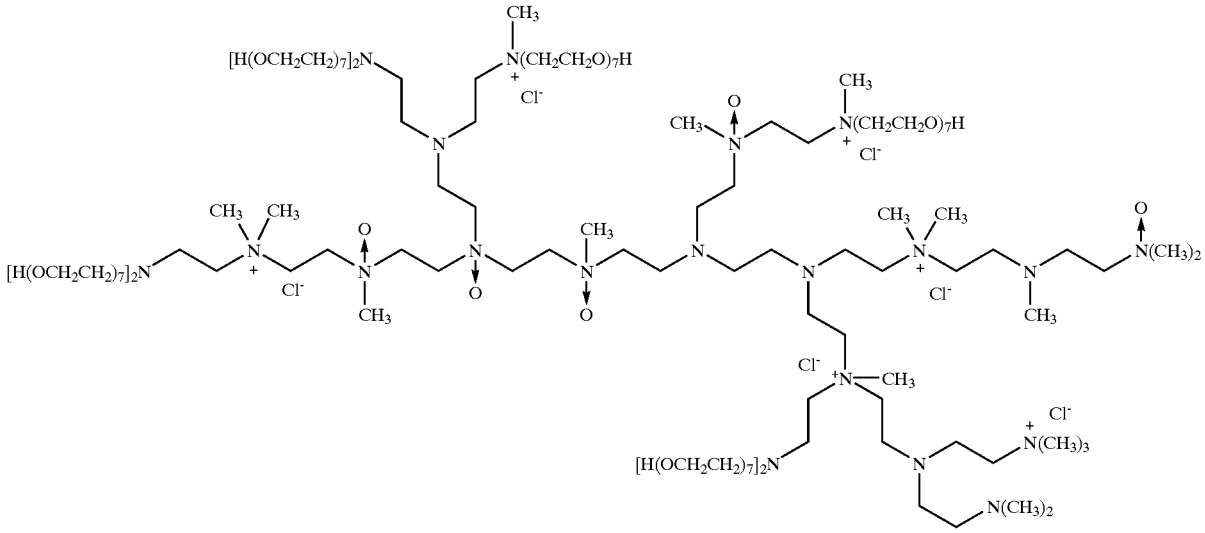

In the above examples, not all nitrogens of a unit class comprise the same modification. The present invention allows the formulator to have a portion of the secondary amine nitrogens ethoxylated while having other secondary amine nitrogens oxidized to N-oxides. This also applies to the primary amine nitrogens, in that the formulator may choose to modify all or a portion of the primary amine nitrogens with one or more substituents prior to oxidation or quaternization. Any possible combination of E groups can be substituted on the primary and secondary amine nitrogens, except for the restrictions described herein above.

The acid-sensitive polymer useful herein is typically provided at levels of from about 0.05% to about 15%, preferably from about 0.1% to about 10%, and more preferably from about 0.2% to about 7%, by weight of the agglomerated particle. If the acid-sensitive polymer herein is a modified polyethyleneimine polymer, it is typically provided at levels of from about 0.05% to about 2%, preferably from about 0.1% to about 1%, and more preferably from about 0.2% to about 0.8%, by weight of the cleaning composition.

The high-melting point liquid useful herein is typically very viscous, and includes liquids whose melting points are less than about 5° C., preferably less than about 20°C., and more preferably less than about 50° C. Preferred high-melting point liquids include, for example, acid-sensitive polymers, nonionic and amphoteric surfactants, suds boosters, anionic surfactants, and mixtures thereof. More preferred high-melting point liquids useful herein include modified polyamine polymers as described above, nonionic surfactants, and surfactant pastes.

The nonionic and amphoteric surfactants useful herein as a high-melting point liquid include the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. The $C_{10}$–$C_{18}$ N-alkyl polyhydroxy fatty acid amides may also be used herein. Typical examples include the $C_{12}$–$C_{18}$ N-methylglucamides. See WO 92/06154 to Cook, et al., published Apr. 16, 1992. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Other conventional useful surfactants are listed in standard texts.

The anionic surfactants useful herein as a high-melting point liquid include conventional branched-chain and random $C_{10}$–$C_{20}$ alkyl sulfates, $C_{10}$–$C_{18}$ secondary (2,3) alkyl sulfates of the formula $CH_3(CH_2)_x(CHOSO_3^-M^+)CH_3$ and $CH_3\ (CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the C10–18 glycerol ethers, the $C_{10}$–$C_{18}$ alkyl polyglycosides and their corresponding sulfated polyglycosides, and $C_{12}$–$C_{18}$ alpha-sulfonated fatty acid esters. Especially preferred is coconut fatty alkyl sulfate, preferably coconut fatty alcohol sulfate paste. Other preferred anionic surfactants include the fatty alkyl sulfates derived from sources such as tallow.

If an anionic surfactant is present herein as a high-melting point liquid, and an acid-sensitive polymer is also present, then the anionic surfactant should be neutralized prior to being added to the agglomeration step. Without intending to be limited by theory, it is believed that this prevents continued degradation of the acid-sensitive polymer during the production process, and storage.

The high-melting point liquid is useful herein at levels of from about 0.5% to about 35%, preferably from about 0.5% to about 10%, and more preferably from about 0.5% to about 5%, by weight of the agglomerated particle.

The present process also provides at least one acid active which is neutralized by the alkaline material. The acid active useful herein is typically the acid form of an anionic surfactant.

The anionic surfactant useful herein typically includes the acid forms of sulfonated surfactants and sulfonated surface-active materials. Especially useful herein are the acid forms of conventional $C_{11}$–$C_{18}$ alkyl benzene sulfonates. Such alkyl benzene sulfonates may be either the branched alkyl sulfonates, the linear alkyl benzene sulfonates ("LAS"), or mixtures thereof.

Typically, the sulfuric and/or sulfonic acid form of the desired anionic surfactant is provided. For example, to provide linear alkyl benzene sulfonate in the agglomerated particle, linear alkyl benzene sulfonic acid may be provided and neutralized in the process herein.

The process herein includes the step of adding the core material and the alkaline material to a mixer and agglomerating therein. The types of mixer useful herein include both the commercially-available batch-type slurry mixers such as V-blenders, ploughshare mixers, Fukae mixers, etc. The processing described herein may be performed in a single mixer, or multiple mixers as desired. Specifically, moderate speed mixers and high speed mixers are preferred herein.

The moderate speed mixer according to the present invention is a mixer having a rotatable central shaft, and typically, several radially-extending arms. As employed in the present invention, a "moderate speed mixer" is a mixer in which the central shaft rotates at a speed of less than about 750 RPM, preferably less than about 500 RPM, more preferably less than about 250 RPM. A preferred moderate speed mixer suitable for use herein is a Lödige KM "Ploughshare". The KM mixer has a rotatable central shaft and several arms extending from the central shaft with a triangular attachment on the end of the arms known as the "plow." Inside the mixer cavity are several smaller blades extending from the wall of the mixer which can be rotated at high speeds. Of course, other moderate speed mixers may also be employed in the present invention and are available from a variety of sources including Schugi. Also useful herein are twin-screw mixers, commercially sold as Eirich, O'Brien and Drais mixers. The typical mean residence time for agglomerated particles within a moderate speed mixer is from about 0.5 minutes to about 15 minutes, preferably from about 2 minutes to about 10 minutes, and more preferably from about 3 minutes about 8 minutes.

The high speed mixer useful herein may be any of a number of commercially available high speed mixer/densifiers such as a Schugi blender/agglomerator or a L ödige CB mixer. Other mixing devices may be employed in the present invention and may include conventional twin-screw mixers. These and other high speed mixers are commercially available from a number of sources. As employed in the present invention, "high speed mixer/densifier" is one which has a central shaft speed of at least about 750 RPM, more preferably at least about 1000 RPM and most preferably at least about 1200 RPM. The preferred high speed mixer/densifier for use in the present invention is a K-G/Schugi blender-agglomerator. The Schugi blender-agglomerator has a central rotating shaft with multiple rotating blades extending from the central shaft and a flexible outer rubber wall to prevent build-up of particles on the outer wall. The typical mean residence time for agglomerated particles within a high speed mixer is from about 0.1 seconds to about 50 seconds, preferably from about 0.1 seconds to about 30 seconds, and more preferably from about 0.1 seconds to about 15 seconds.

The acid active useful herein is typically provided at levels of from about 10% to about 65%, preferably from about 12% to about 45%, and more preferably from about 15% to about 35%, by weight of the agglomerated particle.

The core material, and especially an acid-sensitive polymer, may be provided at a very low concentration, and thus may be difficult to evenly disperse throughout the mixer. Thus, in a preferred embodiment, a carrier is provided within which to disperse or dissolve the core material, prior to the agglomeration step, in order to form a premix. Because the core material is typically either a solid or a viscous liquid, and because of the relatively low concentrations at which the core material is added, a carrier helps to evenly disperse the core material across all particles; i.e., so that each particle contains the core material in the interior thereof. The carrier is typically a liquid, and may serve only as a carrier, or may serve a dual purpose. If the acid-sensitive polymer is to be dispersed therein to form the premix, the carrier is preferably non-acidic, such as water. Also useful herein is a non-aqueous carrier or a basic carrier.

Even though it may cause degradation, in certain cases, it is necessary, or highly convenient to mix an acid-sensitive polymer with the acid active prior to the agglomeration process. This is may occur, when for instance, the mixer contains only a single liquid feed line. Thus, in an embodiment of the invention, it has surprisingly been found that the acid active itself may serve as a carrier. It has been found that the degradation of the acid-sensitive polymer is both concentration-dependent and time-dependent. Thus, the greater the concentration of acid active and/or acid-sensitive polymer present, the faster the degradation reaction. Similarly, the longer the acid active and the acid-sensitive polymer are present together, the greater the degradation.

Accordingly, in the present process, the acid active itself may serve as the carrier for the core material. If the core material is an acid-sensitive polymer, then it is highly recommended to reduce reaction kinetics and degradation of the acid-sensitive polymer. Thus, no more than about 50% of the acid active, preferably no more than about 25% of the acid active, and more preferably no more than about 10% of the acid active should be added to the premix. To reduce reaction time as well as reaction kinetics, it is essential that the premix be added to the mixer as soon as possible. Thus, if an acid active and an acid-sensitive polymer are mixed together to form a premix, the premix should be added to the mixer for the agglomerating step within about 60 minutes, preferably within about 15 minutes of forming the premix. In a more preferred embodiment of the process herein, the acid-sensitive polymer is dispersed in the acid active to form a premix, which is then agglomerated with the alkaline material in the mixer virtually instantaneously; i.e., on the order of about 0.1–10 seconds. This may be accomplished by, for example, placing a second mixer or a static mixer with two liquid feed lines and one outlet line immediately prior to, and leading into the injector tube for the agglomerating mixer. Thus, the acid-sensitive polymer may be dispersed in the acid active in this second mixer, and immediately injected into the agglomerating mixer. Such a process is especially useful in a continuous agglomeration process.

If present, enough carrier must be provided such that the acid-sensitive polymer is easily dispersed, preferably dissolved, therein to form the premix. The weight ratio of carrier to core material in the premix is typically at least about 1:1, preferably from about 1:1 to about 8:1.

In a preferred embodiment, the present process is used in a continuous agglomeration process. In a typical process, at least one injector tube contains the core material, preferably an acid-sensitive polymer, and at least one other injector tube contains the acid active. For example, if a single agglomerating mixer having at least two liquid feed lines is used, then the first feed line may contain the acid-sensitive polymer (either alone or in a premix), which is continuously injected into the agglomerator as alkaline material is continuously added. As the particles are agglomerated and become larger, they move "downstream" through the mixer, where they encounter a second feed line. This second feed line then continuously injects the remainder of the acid active. Thus, the agglomerated particles will contain the acid-sensitive polymer concentrated in the interior thereof.

In another preferred example of a continuous process, two separate agglomeration mixers are linked in series. The acid-sensitive polymer is added to the alkaline material in the first agglomeration mixer. The particles thus formed are then dumped into a second agglomeration mixer, where the acid active is added, and agglomeration is continued.

Examples of the invention are set forth hereinafter by way of illustration and are not intended to be in any way limiting of the invention.

EXAMPLE 1

About 30% soda ash powder, 30% STPP, 6–8% zeolite, 4% sodium sulfate is added to a 50 cubic foot Patterson Kelly V-Blender. About 1% of an acid-sensitive polymer (an acrylic-maleic acid copolymer) is provided, and sprayed onto the powders in the V-Blender. The shell of the V-Blender runs at about 10–20 RPM. The liquid dispersion bar, also called an "I-Bar," runs at 1200–1500 RPM. The acid-sensitive polymer is sprayed on to the powders through the I-Bar. The soda ash and acid-sensitive polymer are then agglomerated for about 3 minutes total, before the acid active is added to the V-Blender through the I-Bar. The acid active is added at a rate of 7–11 kg/min. The amount of acid active added is about 28% of the final composition, by weight. The resulting agglomerates from the V-Blender are cooled in a Fluid Bed Cooler where the fine product is elutriated and added in the next batch of the V-Blender. The cooled agglomerates are sieved to the desired particle size and fed to the next step of the process which is the finishing step.

As a finishing step, optional cleaning ingredients such as optical brightener, enzymes, perborate and bleach activator such as N,N,N'N'-tetraacetyl ethylene diamine and nonanoyloxybenzene sulfonate are added to a mixer along with the agglomerates. Perfumes are sprayed onto the agglomerates in the mixer to make the finished product. The soda ash is at a stoichiometric excess of about 4–8 times that needed to fully neutralize the acid active.

The above process forms an agglomerated particle wherein substantially all of the acid-sensitive polymer is concentrated within the interior of the agglomerated particle. Furthermore, the agglomerated particles possess acceptable acid-sensitive polymer stability. All percentages are by weight of the final agglomerated particle.

EXAMPLE 2

An agglomerated particle is made by the process of Example 1, except 30 that the acid-sensitive polymer is a modified polyethyleneimine polymer having a backbone of about 1800 MW, and a degree of ethoxylation of about 7. The acid-sensitive polymer is mixed instantaneously with a partial amount of the total acid active in a static mixer and fed to the V-Blender. The acid active and the acid-sensitive polymer are pumped independently to the static mixer. The mix rate delivered by the static mixer to the V-Blender is typically 7–11 kg/min. The ratio of the acid active to the acid-sensitive polymer in the premix is in the range of about 1:1.

The above process forms an agglomerated particle wherein substantially all of the acid-sensitive polymer is concentrated within the interior of the agglomerated particle. Furthermore, the agglomerated particles possess acceptable acid-sensitive polymer stability. In such a process, it has been found that the acid-sensitive polymer is stable up to an acid active:acid-sensitive polymer ratio of 10:1.

EXAMPLE 3

In a continuous feed process, soda ash, STPP, and zeolite are fed into a high speed mixer (CB-Lödige 30). The acid-sensitive polymer in the process is fed through the first liquid addition port. The anionic surfactant is fed as an acid active in the following ports. The resulting particles are optionally fed to a vertical high speed mixer (Schugi FX-160). The acid-sensitive polymer could also be added in this stage if it was not added in the first stage. The acid-sensitive polymer spray-on could be followed by spray-on of carbonate, silicate, or another solution. The resulting agglomerates from the Schugi mixer (or the CB mixer if the Schugi mixer is bypassed) are fed to a medium speed KM L ödige (KM-600) mixer. Here, the agglomerates may be dusted with zeolite, or other materials. Binders may also be injected in the KM Mixer. For some products, the KM mixer can be bypassed.

Alternately, all of the transformations described in the CB mixer may be effected with a single KM mixer only (no CB or Schugi). In this case, the acid-sensitive polymer is injected in the first port. Other materials and binders, such as the acid active, are added in the following ports. The binders include, but are not limited to surfactant pastes and acid actives. For example, non-ionic surfactants, silicates, or other aqueous solutions may be used. Where high-melting point liquids which serve as binders are used, it is preferred that they are incorporated into the core of the agglomerate. In this case, they are added first, followed by other binders which could form the outer layers. The acid-sensitive polymer may be fed to the mixer as pure polymer, or with water or other solvents in a premix, and then fed to the mixer. The choice of solvent depends on the stability of the acid-sensitive polymer. Typical operating conditions of the various mixers is given below:

The typical conditions of the Lödige CB mixer (CB-30) mixer is as follows:

Mean residence time: 10–18 seconds

Tip speed: 6 to 13 m/s

Energy condition: 0.15 to 3.5 kj/kg

The typical conditions of the Schugi FX-160 mixer is as follows:

Mean residence time: 0.1 to 2 seconds

Tip speed: 15to 18 m/s

Energy condition: 0.15 to 1.0 kj/kg

In the KM-mixer, the plow RPM is typically 100 and chopper RPM is typically 1300 (three choppers are on the mixer).

The above process forms an agglomerated particle wherein substantially all of the acid-sensitive polymer is concentrated within the interior of the agglomerated particle. Furthermore, the agglomerated particles possess acceptable acid-sensitive polymer stability.

EXAMPLE 4

The composition of the agglomerates is the same as Example 1. In this process the soda ash, STPP, sulfate and zeolite are fed to the continuous CB-30 mixer. A 50% aqueous solution of acid-sensitive polymer is fed into the first liquid injection port in the CB. This is followed by injecting acid active (LAS) in the second, third and fourth injections ports. The resulting agglomerates are fed to the KM-600 where they may be dusted with zeolite, if required, to maintain free flow of the agglomerates. The resulting agglomerates are optionally dried and cooled in a fluidized bed. The elutriated fines are fed at a constant recycle ratio of 10% to 80% in the CB.

The typical conditions of the Lödige CB mixer (CB-30) mixer is as follows:

Mean residence time: 10–18 seconds

Tip speed: 6 to 13 m/s

Energy condition: 0.15 to 3.5 kj/kg

In the KM-mixer, the plow RPM is typically 100 and chopper RPM is typically 1300 (three choppers are on the mixer).

The above process forms an agglomerated particle wherein substantially all of the acid-sensitive polymer is concentrated within the interior of the agglomerated particle. Furthermore, the agglomerated particles possess acceptable acid-sensitive polymer stability.

EXAMPLE 5

The composition of the agglomerates is the same as Example 1. In this process the soda ash, STPP, sulfate and zeolite are fed to the continuous KM-600 mixer. A 50% aqueous solution of acid-sensitive polymer is fed into the first liquid injection port in the KM. This is followed by injecting the acid active (LAS) in the second and third injections ports. The resulting agglomerates are fed to the KM-600 where they may be dusted with zeolite if required to maintain free flow of the agglomerates. The resulting agglomerates are optionally dried and cooled in a fluidized bed. The elutriated fines are fed at a constant recycle ratio of 10% to 80% in the KM.

The mixer conditions are the same as described in Example 4.

The above process forms an agglomerated particle wherein substantially all of the acid-sensitive polymer is concentrated within the interior of the agglomerated particle. Furthermore, the agglomerated particles possess acceptable acid-sensitive polymer stability.

EXAMPLE 6

The composition of the agglomerates and the process is the same as claim 1, except that 3% of a high-melting point liquid (a $C_{12}$ alkyl ethoxylate) and 5% water are added to the acid-sensitive polymer, to form a premix. This premix is then sprayed through the I-Bar.

The above process forms an agglomerated particle wherein substantially all of the core material (acid-sensitive polymer and the high-melting point liquid) is concentrated within the interior of the agglomerated particle. The agglomerates produced by the above process also possess acceptable free-flow properties and acceptable acid-sensitive polymer activity.

What is claimed is:

1. A process for forming an agglomerated particle comprising the steps of:

A. providing at least one alkaline material;

B. providing a core material selected from the group consisting of an acid-sensitive polymer, a high-melting point liquid, and mixtures thereof;

C. providing at least one acid active;

D. agglomerating the alkaline material and the core material in a mixer to form an agglomerated particle comprising:

i. an interior; and ii. an exterior; and

E. adding the acid active to the mixer, wherein the core material is concentrated within the interior of the agglomerated particle by adding substantially all of the core material to the alkaline material before more than about 50% of the acid active is added to the mixer.

2. The process of claim 1, wherein the core material is an acid-sensitive polymer.

3. The process of claim 1, further comprising the step of dispersing the core material with a carrier to form a premix, wherein the premix is formed prior to the agglomerating step.

4. The process of claim 1, wherein the alkaline material is selected from the group consisting of alkali metal and alkali earth metal carbonate, phosphate, silicate, layered silicate, hydroxide, and mixtures thereof.

5. The process of claim 1, wherein the process is a continuous agglomeration process.

6. The process of claim 2, wherein the acid-sensitive polymer comprises a polyamine backbone prior to modification via quaternization, substitution, or oxidation corresponding to the formula:

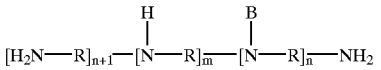

having a modified polyamine formula $V_{(n+1)}W_mY_nZ$ or a polyamine backbone prior to modification via quaternization, substitution, or oxidation corresponding to the formula:

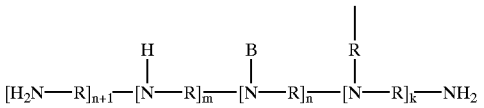

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the formula:

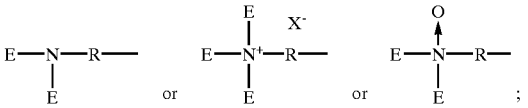

ii) W units are backbone units having the formula:

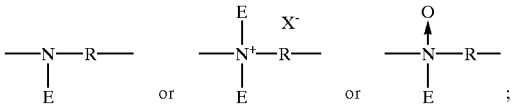

iii) Y and Y' units are branching units having the formula:

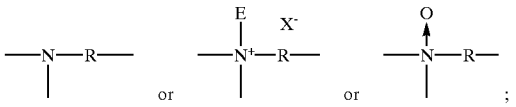

and iv) Z units are terminal units having the formula:

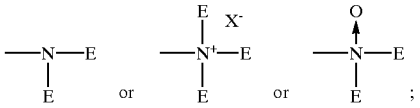

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, , —$CH_2CH(OR^2)CH_2$—, and mixtures thereof; wherein $R^1$ is $C_2$–$C_6$ alkylene and mixtures thereof; $R^2$ is hydrogen, —$(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_{4-C12}$ dihydroxy-alkylene, $C_8$–$C_{12}$ dialkylarylene, —C(O)—, —C(O)$NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_p$ $PO_3M$, —$(R^1O)_xB$, —$C(O)R^3$, and mixtures thereof; provided that when any E unit of a nitrogen is a hydrogen, said nitrogen is not an N-oxide; B is hydrogen, $C_1$–$C_6$ alkyl, —$(CH_2)_q$ $SO_3M$, —$(CH_2)_p$ $CO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1.

7. The process of claim 3, wherein the carrier comprises water.

8. The process of claim 3, wherein the carrier comprises up to about 50% of the acid active.

9. The process of claim 8, wherein the premix is formed for less than about 60 minutes before being added to the agglomerating step.

10. A process for forming an agglomerated particle comprising the steps of:

A. providing at least one alkaline material;

B. providing at least one acid-sensitive polymer;

C. providing at least one acid active;

D. providing at least one carrier;

E. dispersing the acid-sensitive polymer in the carrier to form a premix;

F. agglomerating the alkaline material and the premix in a mixer to form an agglomerated particle comprising:
   i. an interior; and
   ii. an exterior; and G. adding the acid active to the mixer, wherein the acid-sensitive polymer is concentrated within the interior of the agglomerated particle by adding substantially all of the acid-sensitive polymer to the alkaline material before more than about 50% of the acid active is added to the mixer, and wherein the acid sensitive polymer comprises a polyamine backbone prior to modification via quaternization, substitution, or oxidation corresponding to the formula:

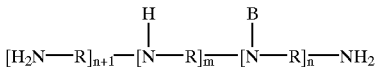

having a modified polyamine formula $V_{(n+1)}W_mY_nZ$ or a polyamine backbone prior to modification via quaternization, substitution, or oxidation corresponding to the formula:

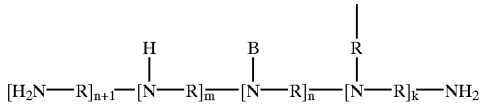

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the formula:

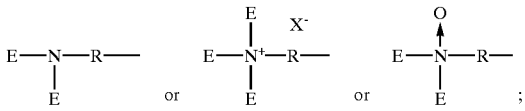

ii) W units are backbone units having the formula:

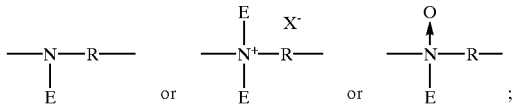

iii) Y and Y' units are branching units having the formula:

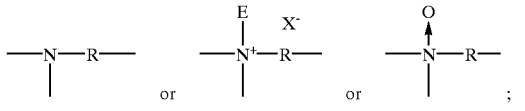

and iv) Z units are terminal units having the formula:

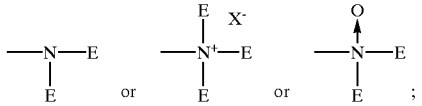

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is $C_2$–$C_6$ alkylene and mixtures thereof, $R^2$ is hydrogen, —$(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —$C(O)NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_p PO_3M$, —$(R^1O)_xB$, —$C(O)R^3$, and mixtures thereof; provided that when any E unit of a nitrogen is a hydrogen, said nitrogen is not an N-oxide; B is hydrogen, $C_1$–$C_6$ alkyl, —$(CH_2)_qSO_3M$, —$(CH_2)_p CO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1.

* * * * *